United States Patent [19]

Sampson et al.

[11] Patent Number: 4,930,911

[45] Date of Patent: Jun. 5, 1990

[54] FLAT-BED HEATED FINGER DAISY WHEEL HOT DEBOSSING STAMPER

[75] Inventors: Craig F. Sampson; Rickson Sun; Paul N. Barsley, all of Palo Alto; Dennis J. Boyle, Menlo Park, all of Calif.

[73] Assignee: Taurus Impressions, Inc., Calif.

[21] Appl. No.: 277,399

[22] Filed: Nov. 28, 1988

Related U.S. Application Data

[63] Continuation of Ser. No. 855,541, Apr. 24, 1986, abandoned.

[51] Int. Cl.[5] ..... B41J 1/30; B41J 3/28

[52] U.S. Cl. ..... 400/28; 400/24; 400/31; 400/29; 400/120; 400/144.2; 400/134.1; 101/27; 101/29; 101/336

[58] Field of Search ..... 400/24, 27, 29, 31, 400/28, 120, 174, 175, 144.1; 101/27, 29, 336

[56] References Cited

U.S. PATENT DOCUMENTS

| | | | |
|---|---|---|---|
| 879,814 | 3/1908 | Donning | 400/31 |
| 1,128,225 | 2/1915 | Choate | 400/134 |
| 1,406,537 | 2/1922 | Choate | 400/120 |
| 1,979,640 | 11/1934 | Roberts | 41/7 |
| 2,076,198 | 4/1937 | Honnolke | 400/142 |
| 2,651,400 | 9/1953 | Young et al. | 197/2 |
| 2,687,795 | 8/1954 | Wise | 197/3 |
| 3,301,370 | 1/1967 | Miller | 101/27 |
| 3,353,645 | 11/1967 | Palmer | 400/29 |
| 3,447,656 | 6/1969 | Nyquist | 197/2 |

(List continued on next page.)

FOREIGN PATENT DOCUMENTS

| | | | |
|---|---|---|---|
| 0099442 | 2/1984 | European Pat. Off. . | |
| 2451436 | 5/1976 | Fed. Rep. of Germany . | |
| 2716067 | 10/1977 | Fed. Rep. of Germany | 400/29 |
| 2812484 | 9/1979 | Fed. Rep. of Germany | 400/25 |
| 3211451 | 10/1982 | Fed. Rep. of Germany | 400/25 |
| 3531898 | 3/1986 | Fed. Rep. of Germany . | |
| 2446722 | 9/1980 | France | 400/24 |
| 229373 | 12/1984 | Japan | 400/25 |
| 2044180 | 10/1980 | United Kingdom . | |
| 2152436 | 8/1985 | United Kingdom | 400/29 |

OTHER PUBLICATIONS

Mink, "Compact . . . Typewriter" IBM Tech. Disclosure Bulletin, vol. 25, No. 7a, pp. 3196–3197 12/82.

Acromark Hot Stamping Systems brochure, the Acromark Company, Inc., pre–1986. 6 pages.

Franklin stamping machine brochures, Franklin Manufacturing Corporation, Model 115 11/83 and Super Regal Model 11/79, 2 pages each, pre–1986.

Kwikprint stamper brochure, Models 86, AA and 64, pre–1986, 3 pages.

WEGO printer brochure, Precision Machine, Inc., pre–1986, 4 pages.

"Automark Marking Systems" ACEP–J1B Brochure, Defiance Machine and Tool Co., Inc., published February, 1985 (Exhibit A).

"Easymark" Hot Foil Lettering Brochure, Didde Graphic Systems Corporation (Exhibit B).

*Primary Examiner*—William Pieprz

*Attorney, Agent, or Firm*—Skjerven, Morrill, MacPherson, Franklin & Friel

[57] ABSTRACT

A peripheral or stand-alone computerized stamp printer is provided particularly for office use in which a print assembly including a pressure cam and leaf spring arrangement is associated with a heated print head which contacts and impresses a daisy wheel character against an imprinting tape in a confined cartridge to serially print computer-selected letters or characters on a binder, binder spine, or other workpiece. The printer assembly may move on an X or Y axis along a fixed or movable gantry upper arm. If the gantry is fixed, means are provided for moving paper stock, binders or other workpieces into proper position for clamping on a work surface on the top surfaces of the printer chassis. A spine-holding drawer may be provided in the chassis for supporting the spine of a binder for printing letters, logos, or the like, on the binder spine. The print assembly is a discrete unit and includes a replaceable tape cartridge fitted into drive mechanisms within the printer assembly.

12 Claims, 9 Drawing Sheets

U.S. PATENT DOCUMENTS

| | | | |
|---|---|---|---|
| 3,585,540 | 6/1971 | Bernard | 400/29 |
| 4,015,699 | 4/1977 | Kondur, Jr. | 197/57 |
| 4,027,591 | 6/1977 | Gubela | 101/407 BP |
| 4,037,532 | 7/1977 | Plaza et al. | 101/93.48 |
| 4,044,665 | 8/1977 | Kuhne et al. | 101/21 |
| 4,074,798 | 2/1978 | Berger | 400/174 |
| 4,126,400 | 11/1978 | Suzuki et al. | 400/174 |
| 4,147,438 | 4/1979 | Sandrone et al. | 400/144.2 |
| 4,202,637 | 5/1980 | Tummelo | 400/31 |
| 4,277,186 | 7/1981 | Takahashi | 400/120 |
| 4,308,794 | 1/1982 | Adamoli et al. | 101/93.03 |
| 4,327,635 | 5/1982 | Kelly et al. | 101/18 |
| 4,373,436 | 2/1983 | Shenoha | 101/336 |
| 4,416,199 | 11/1983 | Davison | 101/193 |
| 4,443,124 | 4/1984 | Ozawa | 400/185 |
| 4,509,872 | 4/1985 | Shimogawara | 400/185 |
| 4,516,493 | 5/1985 | Schemenauer | 101/27 |
| 4,536,775 | 8/1985 | Calnek et al. | 400/120 |
| 4,541,746 | 9/1985 | Bobart et al. | 400/144.2 |
| 4,542,690 | 9/1985 | Kikuchi | 101/27 |
| 4,544,289 | 10/1985 | McGourty et al. | 400/154.5 |
| 4,545,695 | 10/1985 | Agata | 400/320 |
| 4,620,808 | 11/1986 | Kurtin et al. | 400/691 |
| 4,647,234 | 3/1987 | Isobe | 400/656 |
| 4,673,304 | 6/1987 | Liu et al. | 101/336 |
| 4,764,038 | 8/1988 | Nakajima | 400/120 |

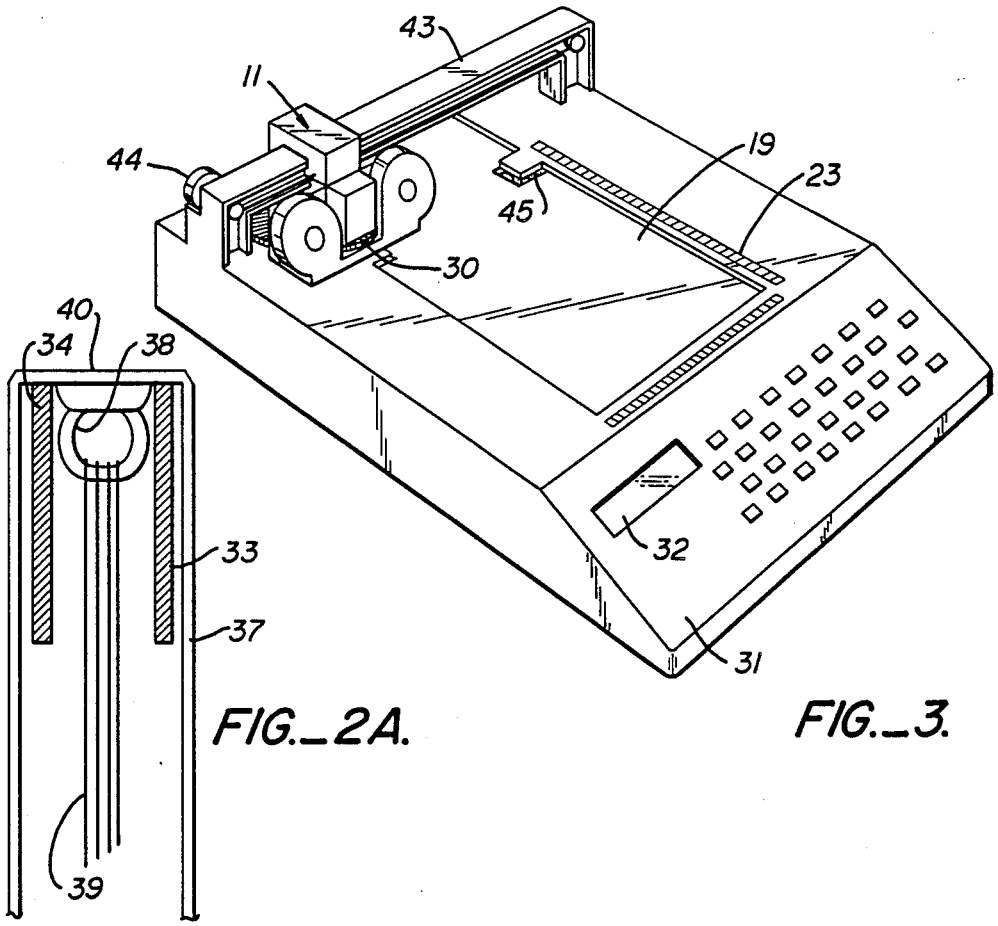
FIG._2A.
FIG._3.
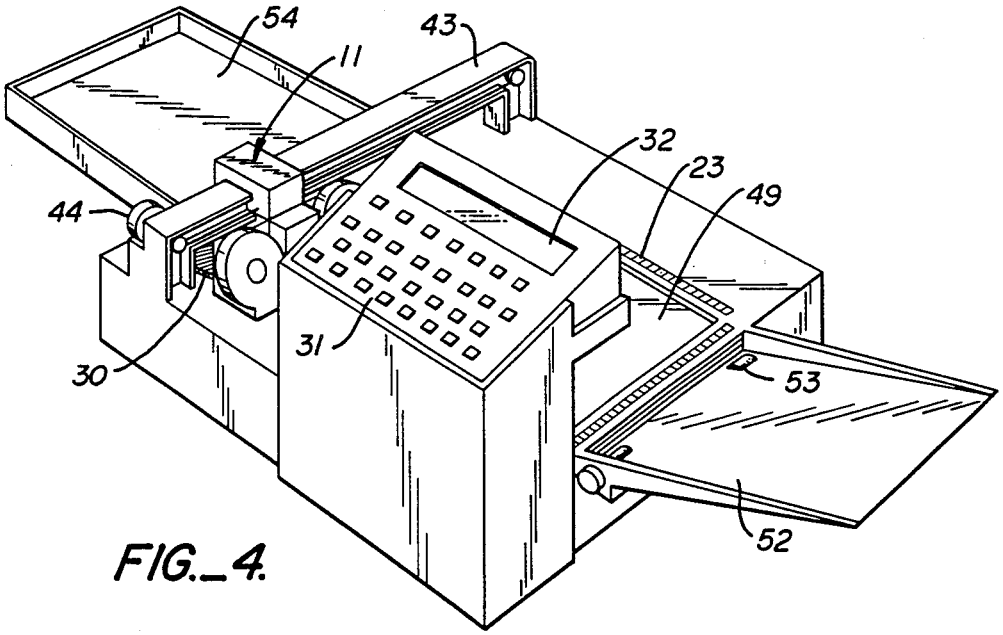
FIG._4.

133
ADDRESS DECODER
1
12
120
MICRO-PROCESSOR
132
ALE
153
ADDRESS LATCH
121
X HOME DETECTOR
7
122
BUFFER
INTERRUPT
123
124
Y HOME DETECTOR
125
127
8
CHARACTER WHEEL HOME DETECTOR
BUFFER
6
146
KEYBOARD INTERFACE
X-Y LINEAR TEXT POSITION SWITCH
FOIL TYPE DETECT
INTER-LOCK
126
129
130
9
CHARACTER WHEEL TYPE DETECTOR
BUFFER
131
FOIL LENGTH DETECTOR
147
148
145
ALPHA NUMERIC KEYBOARD

FLAT-BED HEATED FINGER DAISY WHEEL HOT DEBOSSING STAMPER

This is a continuation of Ser. No. 855,541, filed Apr. 24, 1986, now abandoned.

BACKGROUND OF THE INVENTION

1. Field of the Invention

This invention is directed to a serial stamp printer and method for imprinting title, logo, author and other information on the cover or spine of a book, booklet, or the like, which is operable by personnel in the normal office environment.

2. Material Art

The majority of printing of titles, authors and other information on book bindings is accomplished by contract binderies and print shops in which a desired series of letters and type fonts are assembled in a jig, either by hand, with the use of an automatic typecaster, or by preparing an etched metal die from art work. The completed jig or slug of type or die is transferred to a printing position where an overall imprint, for example, of the book title, author, report name and number, is simultaneously imprinted on the front and spine of the book. Such systems are oft time complex and take a trained operator or printer to perform the printing functions. Turn-around time is a major problem. These systems are exemplified by a typewriter as in U.S. Pat. No. 879,814; U.S. Pat. No. 2,076,198; a graph plotter machine as in U.S. Pat. No. 2,651,400; a flat platen typewriter as in U.S. Pat. No. 2,687,795; a printer as in U.S. Pat. No. 4,545,695 employing X-Y movement; and No. 4,544,289 employing dry pressure inked tapes. Other U.S. Patents such as No. 4,277,186 disclose heat sensitive or thermal printing or heat transferable lettering to the workpiece. Commercial machines include the WEGO one line, two line and three line hot-foil printer; the Automark microprocessor controlled, computerized branding typewriter for hot stamping of plastics at programmable memory locations; the KWIKPRINT Model 86 hand operated stamper using type slugs; various Franklin stamping machines; and various Acromark hot stamping presses.

SUMMARY OF THE INVENTION

The present invention includes a gantry-like assembly and a movable printer assembly including a rotating character wheel in association with a transfer foil cartridge for pressure implanting a series of transfer foil characters on a workpiece, particularly on marketing, engineering and business office-type reports and booklets.

Provision is made for stand alone units, or units plugged to an office or personal computer, which are capable of stamp printing titles, names, logos, and report numbers on covers or spines of office-bound printed materials. In a preferred embodiment, a pressure-cam and leaf spring arrangement is associated with a heating element head which contacts and presses a daisy-wheel character-containing finger against a pigmented tape confined in a cartridge to serially print computer-selected letters or other characters on the workpiece. Of significance is a novel print tape cartridge including indicating means for determining strike and dwell time and temperature for particular types and for particularly sized characters. Another feature of the invention is an associated simple mechanism for supporting a booklet spine for imprinting using the same printing assembly as used on a flat report or booklet cover. Fully formed characters of professional quality, rather than characters of the dot matrix character normally generated by a computer-type printer, result from use of the preferred embodiment of the invention. Such characters are melt-impressed from a pigmented wax or metallic particle-containing wax on a Mylar ribbon resulting, for example, in a metallic embossed sharp, crisp impression of high quality. A further aspect of the invention involves data entry into a computer, storing of the instructions for placement of desired impressions on the workpiece, appropriate data display and a "start" button which commences the serial printing of the required characters on the report cover or spine. The result of the invention is the remove work from a craft shop and have in-house printing capability comparable in quality to that of the professional craft printing shop yet operated by office, clerical and secretarial workers with only a few minutes of instruction. A novel printer assembly in which a character wheel, pressure cam, transferable foil cartridge, and spring-mounted print head are combined is also part of the invention.

BRIEF DESCRIPTION OF THE DRAWINGS

FIG. 2A is a partial cross-sectional view of a report binder positioned on an extended spine-holding drawer.

FIG. 3 is a perspective view of a stand-alone printer employing a moving workpiece and a fixed gantry.

FIG. 4 is a stand-alone computerized printer with moving workpiece capability involving automatic feed of sheet cover stock.

FIGS. 13, 13A and 13B are a flow diagram for operational control of a hot stamp printer of this invention.

DETAILED DESCRIPTION

Figure 1:
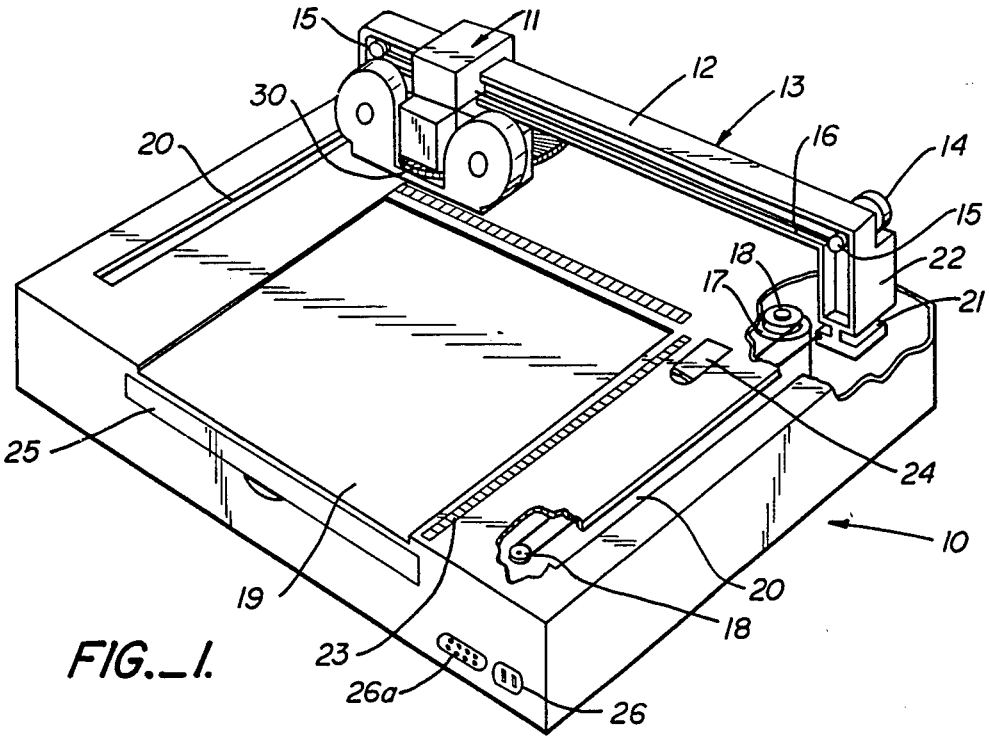
FIG. 1 is a partially cutaway perspective view of a computer peripheral stamp printer for use with static workpieces.

The overall assembly of the stamp printer 10 of the invention is shown in a preferred embodiment in FIG. 1. Stamp printer 10 includes a printer assembly 11 moveable in a Y-axis orthogonal direction along a gantry arm 12 of a gantry 13. The printer assembly is moved along gantry arm 12 by a first stepper motor 14 which rotates pulleys 15 to drive printer assembly along gantry arm 12 by a pulley cord or belt 16 fixedly attached to the printer assembly 11. A second stepper motor 17 drives a pulley 18 for moving gantry 13 in an X-axis orthogonal direction with respect to a printer top work surface 19. A suitable belt or pulley cord extends around pulleys 18 to drive gantry 13 along a pair of spaced parallel rails 20 extending between the pulleys under the printer top surface. Slots 21 on the exterior of vertical legs 22 of gantry 13 ride along the rails 20. Rows and columns of linear composing switches 23 shown in more detail in FIG. 17 extend on the edges parallel to the X-and Y-axis of the work surface 19 to discretely indicate the desired position of the text to be printed.

The overall assembly may include a document clamp mechanism 24 and a ring binder spine-support drawer 25 explained below. A character daisy wheel 30 extends from the printer assembly 11 and is rotated to present characters for imprinting at a specific X- and Y-axis location on a workpiece clamped on work surface 19 by clamp mechanism 24. Lastly an electrical plug-in connection 26 and computer connection **26*a* is provided so that the overall peripheral unit 10 may be plugged into an associated personal computer or the like. The working surface 19** may accommodate paper sheet stock, binder covers and also flattened out D-ring spines.

Figure 2:
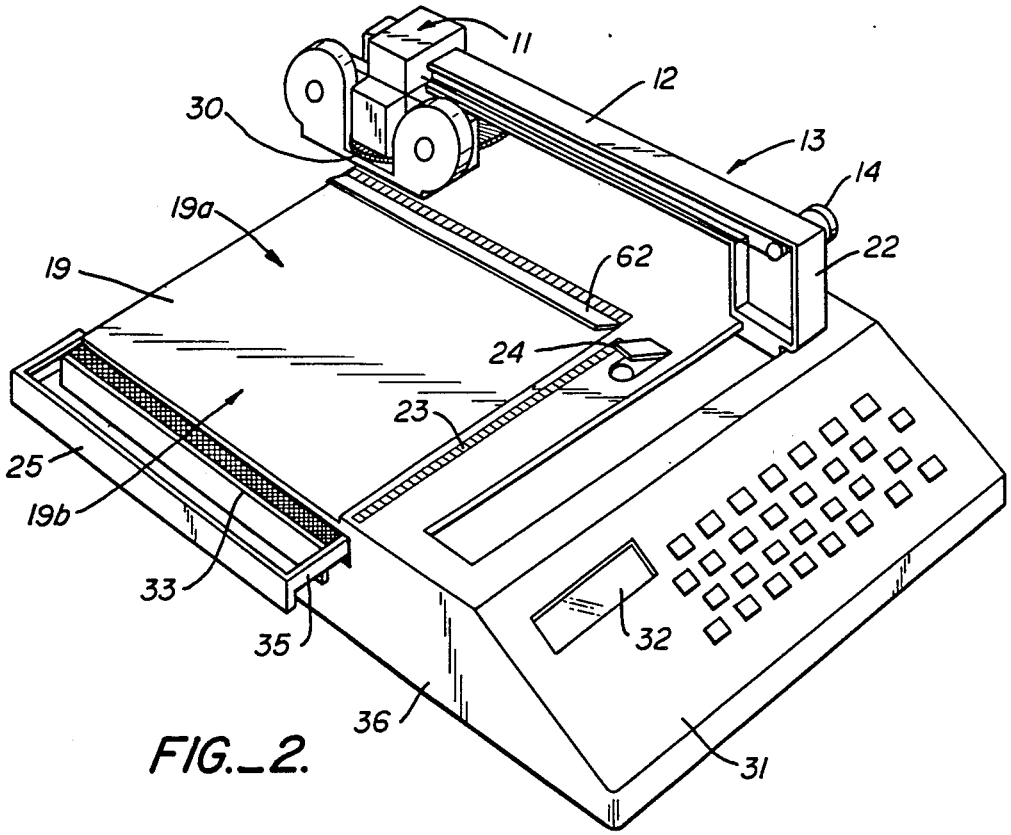
FIG. 2 is a perspective view of a stand-alone computerized printer with a spine-holding drawer.

FIG. 2 shows a stand-alone stamp printer including an integrated keyboard and control unit 31. A LCD or other user feedback display 32 may be included to show the user the letters or characters to be printed by the printer assembly 11. It is to be noticed that the work surface 19 may be accessed from two orthogonal directions so that workpiece material may be slid in the direction indicated by arrow line **19*a* or in the direction indicated by arrow line 19*b*. The spine support drawer 25 comprises a pair of horizontal parallel support bars 33 and 34 which extend from drawer end pieces 35. In the drawer "out" which extend from drawer end piece 35. In the drawer "out" position shown in FIG. 2 support bars 33 and 34 extend outward of side wall 36 of the overall printer chassis, so that as shown schematically in FIG. 2A a ring binder 37 (e.g. a conventional three-ring binder) having a fixed internal separable ring 38 for holding hole-punched sheets of paper 39 is placed downwardly over bars 33 and 34 so that a top surface 40 of the binder spine may be imprinted by printer assembly 11 when gantry 13 has been moved to its far left position with respect to the overall chassis of the printer. The printing head character wheel periphery thus extends laterally outwardly of side wall 36 so that it is in position to overlay and stamp press character letters or logos on spine surface 40**.

FIG. 3 illustrates an embodiment of the invention in which printer assembly 11 is driven on a fixed gantry 43 in the X-axis direction by stepper motor 44. Stepper motor 44 and stepper motors 14 and 17 shown in FIG. 1 may be Model TF55-48 motors available from Kollmorgen Corporation. In the FIG. 3 embodiment the work surface 19 is bordered at its side edges by rollers 45 extending from under the work surface 19 so as to control movement of paper stock or workpieces placed above the rollers in the Y-axis to the proper imprinting position under the X-axis translating printer assembly 11.

FIG. 4 illustrates an embodiment in which a stand-alone printer is provided with automatic feed of moving workpiece material. A "home" position is provided for positioning the printer assembly and the gantry (if movable) with respect to the work surface to provide a known start position for the printer assembly and/or gantry. In this embodiment, workpiece work surface 49 accommodates sheet stock only. A bin 52 is provided to receive unprinted sheet stock and sheets are movable over rollers 53 for feeding onto surface 49. An out-tray 54 is providing for receiving printed sheet stock.

Figure 5:
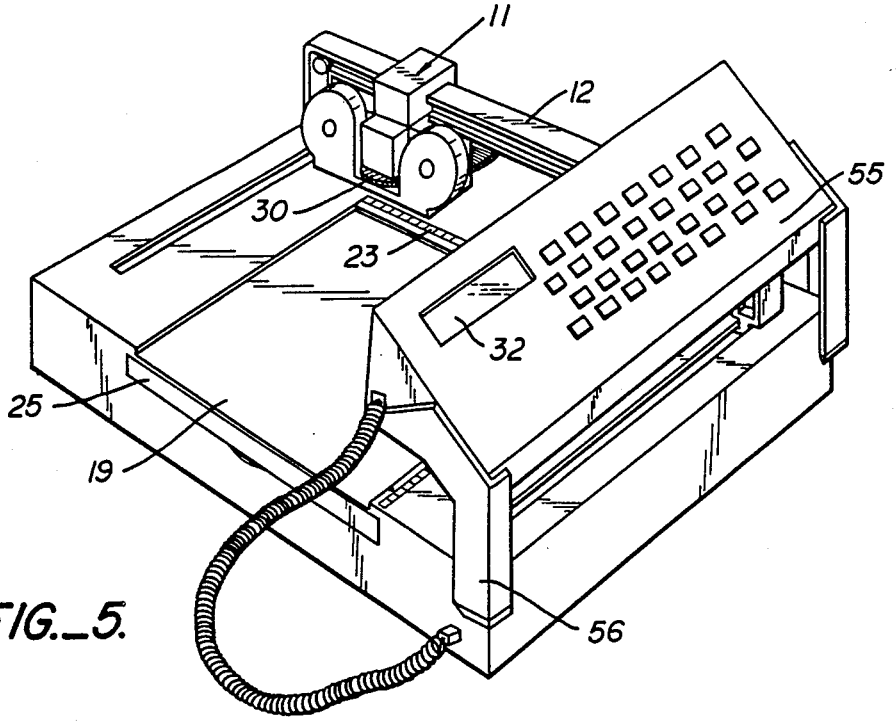
FIG. 5 is a stand-alone computerized printer for static workpieces including a detachable data entry and data display computer unit.

FIG. 5 shows a further modification of the invention wherein a detachable keyboard 55 is mounted for storage on or operation on or off a pair of vertical supports 56.

Figure 6A:
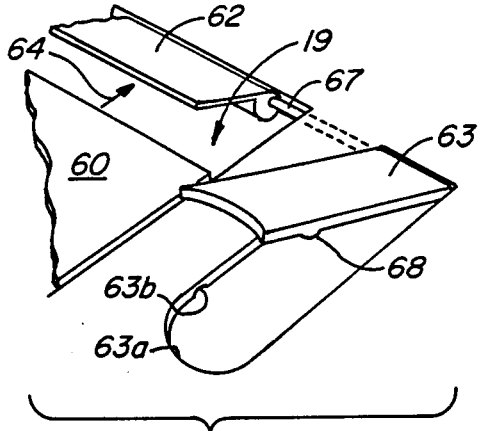
FIG. 6A is a partial perspective schematic view of a document clamp mechanism in open position.
Figure 6B:
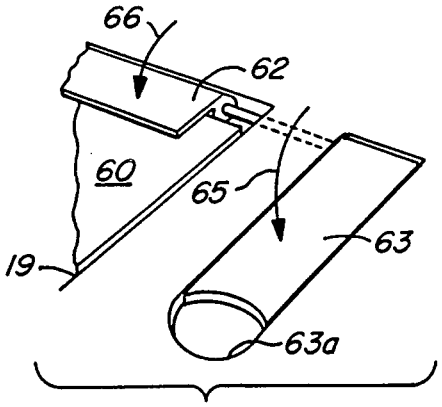
FIG. 6B is a partial perspective view of a document clamp mechanism in closed clamping position.

Operation of the document clamp mechanism 24 is seen in detail in FIG. 6A and FIG. 6B. In FIG. 6A a sheet 60 of the document or binders to be imprinted is placed on work surface 19 and extended along arrow path 64 to a clamping strip 62 extending from side edges of the top surface of the printer assembly as shown in FIG. 2. A clamp actuator arm 63 is provided which is fixedly attached to a rod 67 which connects strip 62 and actuator arm 63. Pushing down actuator arm 63 as shown by arrow 65 snaps actuator 63 into a position as shown in FIG. 6B in which clamp actuator 63 lies generally in the plane of the working surface 19. This causes clamping strip 62 to rotate downwardly as shown by arrow 66 so that it clamps sheet 60 against working surface 19. An end surface of arm 63 is arched which in conjunction with an extended slot **63*a* in the chassis top surface thereby allowing entry of an operator's finger to lift arm 63 to the "open" position. A raised bump 68 and detent 63*b* may also be included to friction-lock arm 63** into the sides of the slot.

Figure 7:
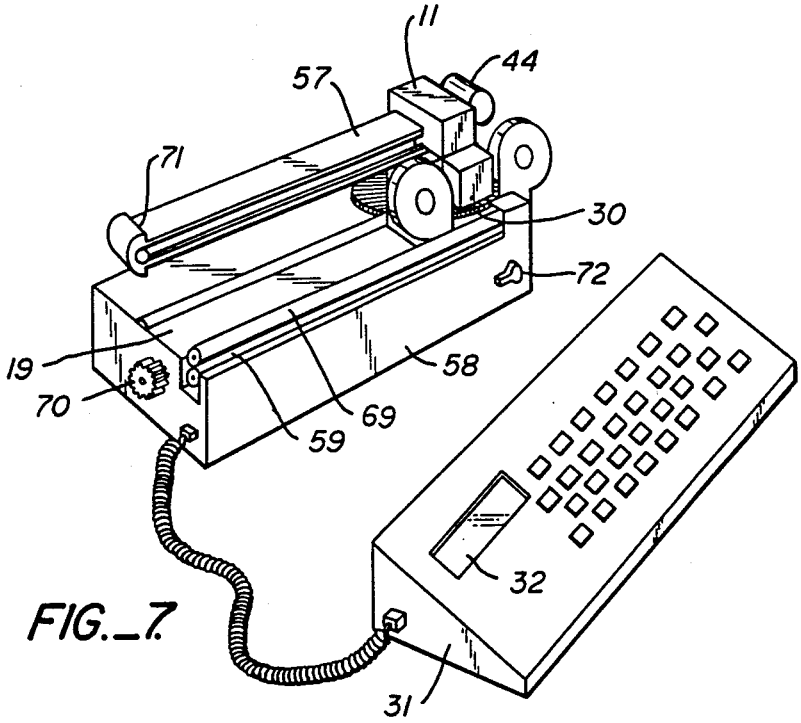
FIG. 7 is a perspective view of a further embodiment of a stand-alone computerized printer having a workpiece moving mechanism.

FIG. 7 illustrates a further embodiment of a stand-alone unit which includes a cantilevered gantry 57 fixed with respect to printer chassis 58. A lateral entrance 59 is provided so that sheets of material may be fed into the nip of a pair of rollers 69 positioned parallel to entrance 59. Rollers 69 may be hand operated by a roller knob 70 so as to incrementally move the paper stock into position on work surface 19. Control knob 72 functions to release and clamp rollers 69 for easy insertion of a workpiece. As with the other embodiments, printer assembly 11 moves along in an X-axis direction on cantilevered gantry arm 57. Suitable stop means 71 are provided at the end of gantry arm 57 to prevent over motion of printer assembly 11.

Figure 8:
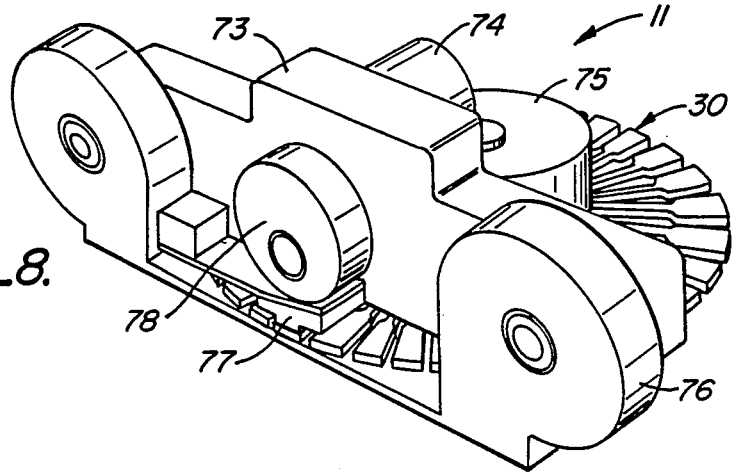
FIG. 8 is a perspective view of a printer assembly of this invention.

FIG. 8 shows a printer assembly including an elongated chassis 73 supporting a DC motor 74 for pressure cam rotation and for cartridge foil advance. A motor such as a Model RS-3605-2495 available from Mabuchi Motor Company, Ltd., or a similar motor, is useful for this purpose. The chassis also supports a 96-position stepper motor 75 for moving the character wheel 30 into various positions under a print head 77. Chassis 73 also supports and provides a gear drive therein for driving a foil tape within a plug-in cartridge 76. Motor 74 drives a pressure cam 78 in rotation to provide cam high-point pressure on a spring-mounted print head 77 which forces a finger of character wheel 30 against the workpiece underneath the printer assembly.

Figure 9:
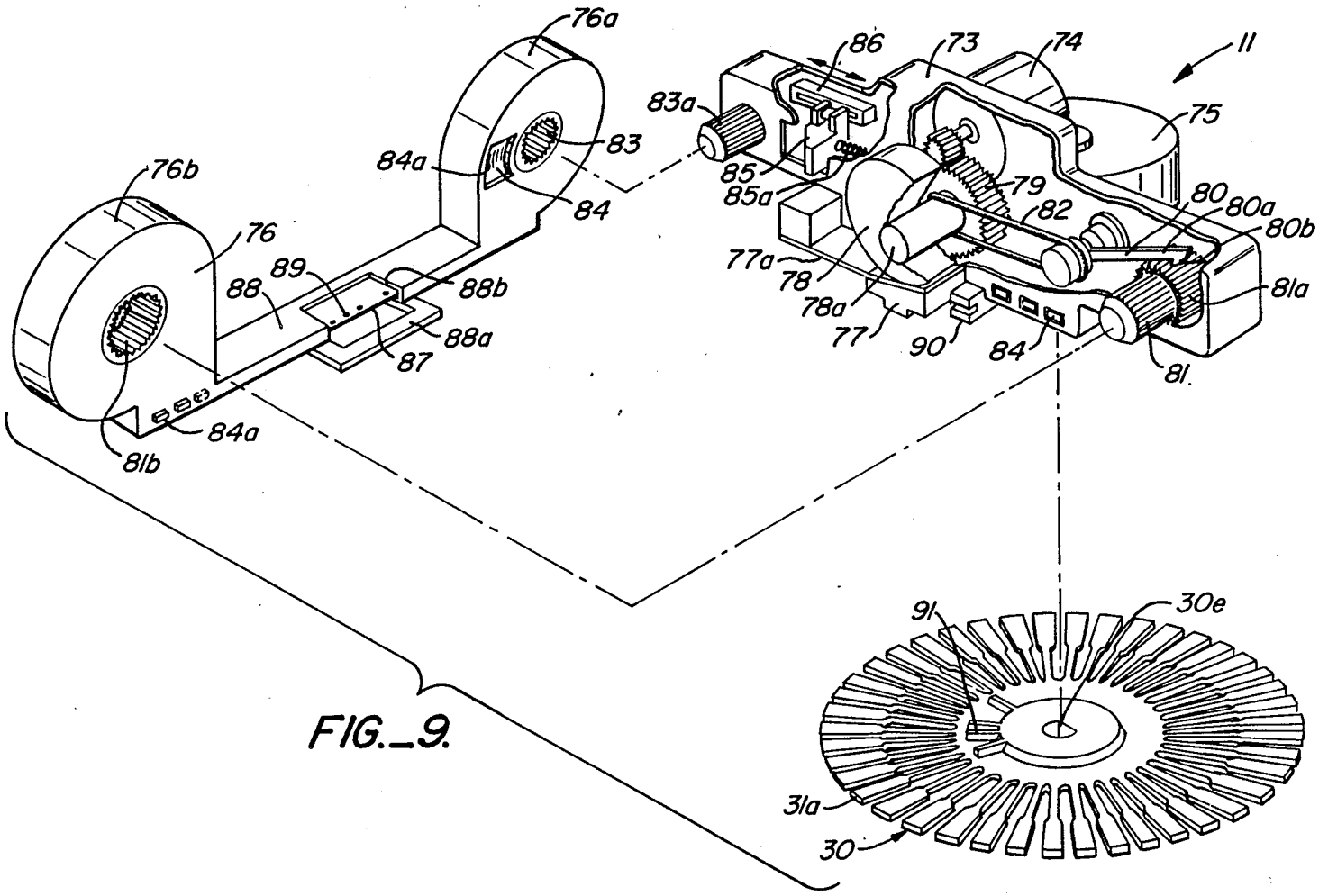
FIG. 9 is an exploded partially cut away perspective view of the printer assembly of the invention.

FIG. 9 is an exploded view of the printer assembly 11. Chassis 73 contains a set of gears 79 which drive a spindle 78*a* of cam 78. Simultaneously, an intermittent foil advance mechanism 80 is indexed by rotation of belt 82 so that arm 80*a* with a ratchet end 80*b* rotates a foil-advancing spindle 81 by ratcheting the ratchet grooves 81*a* at one end of spindle 81. The action achieved is one which advances the foil only during the portion of the cam cycle when the cam is not pressing on the print head. Cartridge 76 is placed over spindle 81 so that transverse gear teeth 81*b* of one cartridge end 76*b* mesh with the gear teeth on spindle 81 while a second bore 83 on a second upstanding cartridge end 76*a* meshes in free rotation with smooth spindle 83*a* extending from chassis 73.

Transfer tape 87 extends on reels within each of the upstanding end portions of cartridge 76 which are connected by bridge portion 88. A "full" reel is placed in upstanding cartridge section 76*a* and a takeup reel in upstanding section 76*b*. A tape level-measurement window 84 is provided on the inside surface of the cartridge end 76*a* for detection of the amount of foil remaining on the tape discharging spool. A foil level-measurement slider 85 extends from chassis 73 so that the slider 85 passes through window 84 and is in contact with the outer coil of the multicoil coils of foil on the discharging spool. Slider 85 is spring operated utilizing spring 85*a* so that it presses slider 85 against the roll of the tape as it becomes lessened in diameter from its incremental movement in the cartridge towards the takeup reel in cartridge section 76*b*. A portion of the slider 85 rides in a slide potentiometer 86 to detect the particular tape level on the reel.

It is desirable to be able to detect the type of foil within a particular cartridge so as to be able to change the heating cycle, for example, for the print head 77. In a first embodiment a series of bump indicators 84*a*, including either one, two or three bumps, will indicate which one of multiple foil types is within the cartridge. A series of switches 84 on the chassis side facing the cartridge detects the bumps 84*a* to determine the type of foil inside the cartridge. In a second embodiment the foil 87 may contain a series of detectable edge holes 89 in spaced patterns. In such an embodiment, the edge of foil 87 passes through a light emitter/detector pair 90 which senses the hole pattern indicating the type of foil. Typical foils usable with the invention are hot transfer foils of the G.P. series and P-and V-Series manufactured by Dri-Print Foils, Rahway, New Jersey, and Kurz-Hastings, Inc., Philadelphia, Pennsylvania, respectively. Pressure transfer foils which function at room temperature can also be used, e.g. such as Goldmarc foils distributed by Rare Additions, Ltd. of Lynbrook, New York. A frame 88*a* containing a central opening is provided integral with bride 88 of the cartridge for pressing against the workpiece and providing an open area through which the print head 77 extends along with the tip of a finger 31*a* of the character wheel 30. An opening 88*b* is provided on bridge 88 for the same purpose as the frame central opening. The spring pressure head 77 is normally mounted to the chassis by a leaf spring 77*a*.

Ribs 91 may be provided in an inner peripheral area of character wheel 30 for identifying a particular character wheel which may or may not require special heating or special spacing because of character size.

Figure 10:
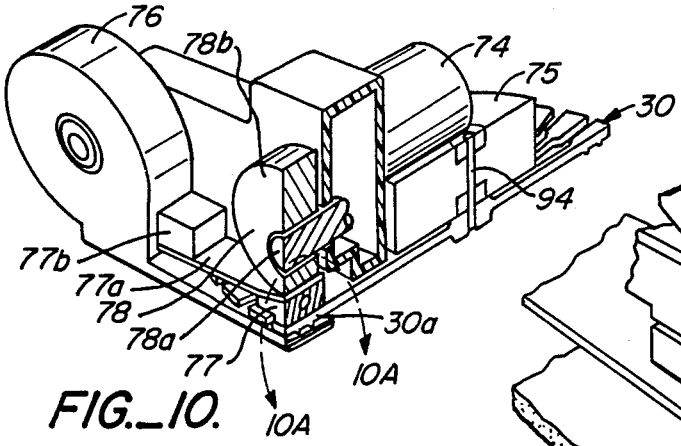
FIG. 10 is a perspective cross-sectional view of one half of the printer assembly.
Figure 10A:
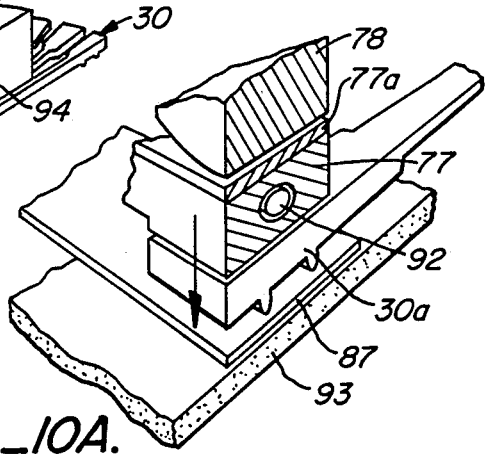
FIG. 10A is a blowup of a circled portion of the print head of the printer assembly shown in FIG. 10.

FIG. 10 illustrates the connection of stepper motor 75 to character wheel 30. The stepper motor may be a Model BH-96-35-34 motor manufactured by Brother Industries, Ltd., or a similar motor. The character wheel 30 is normally made of die cast aluminum or zinc as is known in the art. Pressure head 77 contains a heating element 92 inside the pressure head as more clearly seen in FIG. 10A. A transverse heating element, such as a Firerod electrical heating element manufactured by Watlow Company may be employed. Heating element 92 heats print head 77. When a facing hot surface of the head is placed in contact with the top surface of the finger 30*a*, the indicia character on the bottom side is conductively heated. Succeeding fingers are incrementally placed in position under the pressure head 77 by movement of the stepper motor to the proper indexing position (with the print head in the "up" position) indicating the particular character or letter to be printed in sequence. As cam 78 rotates and as the upper portion 78*b* of the cam 78 reaches its bottom position against the top of spring-pressed print head 77, the head downwardly pushes against the character wheel finger 30*a*, which in turn moves downwardly against the foil tape 87 to imprint the particular character embossed on finger 30*a* on the workpiece 93, as indicated by the downward arrow.

Figure 11:
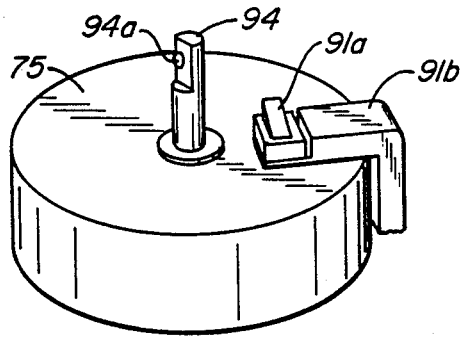
FIG. 11 is a bottom perspective view of a character wheel stepper motor.

FIG. 11 shows the underside of the stepping motor 75 with a motor shaft 94 extending therefrom. A spring-loaded ball 94*a* may extend from a flattened portion on the spindle 94 to retain the character wheel 30 in position when a character wheel central aperture 30*e* is placed on stepper spindle 94. A cam-following type switch 91*a* may be supported on a bracket 91*b* to detect the sequence of ribs 91 on the character wheel to determine whether a particular heating cycle or spacing should be used with respect to that particular wheel or characters (logos) thereon. In an alternative embodiment, a light emitter/detector pair which reads a label using existing bar code technology on the wheel may be employed.

Figure 12:
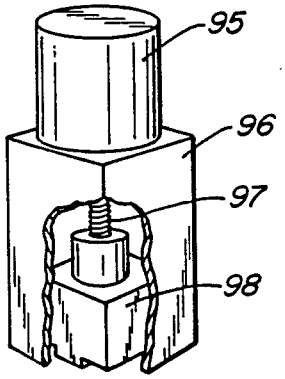
FIG. 12 is a cut away perspective view of an alternative embodiment of the print head actuating mechanism.

FIG. 12 is an embodiment of the invention wherein a driver motor 95 having a driven loose lead screw 97 extending therefrom drives a pressure head 98 guided by housing 96 into a pressing engagement with a finger of the character wheel and the foil of the cartridge so as to imprint a character or indicia on the workpiece. FIG. 12 illustrates a mechanism which may be substituted for the cam and spring pressed pressure head of FIG. 10.

Figure 13A:
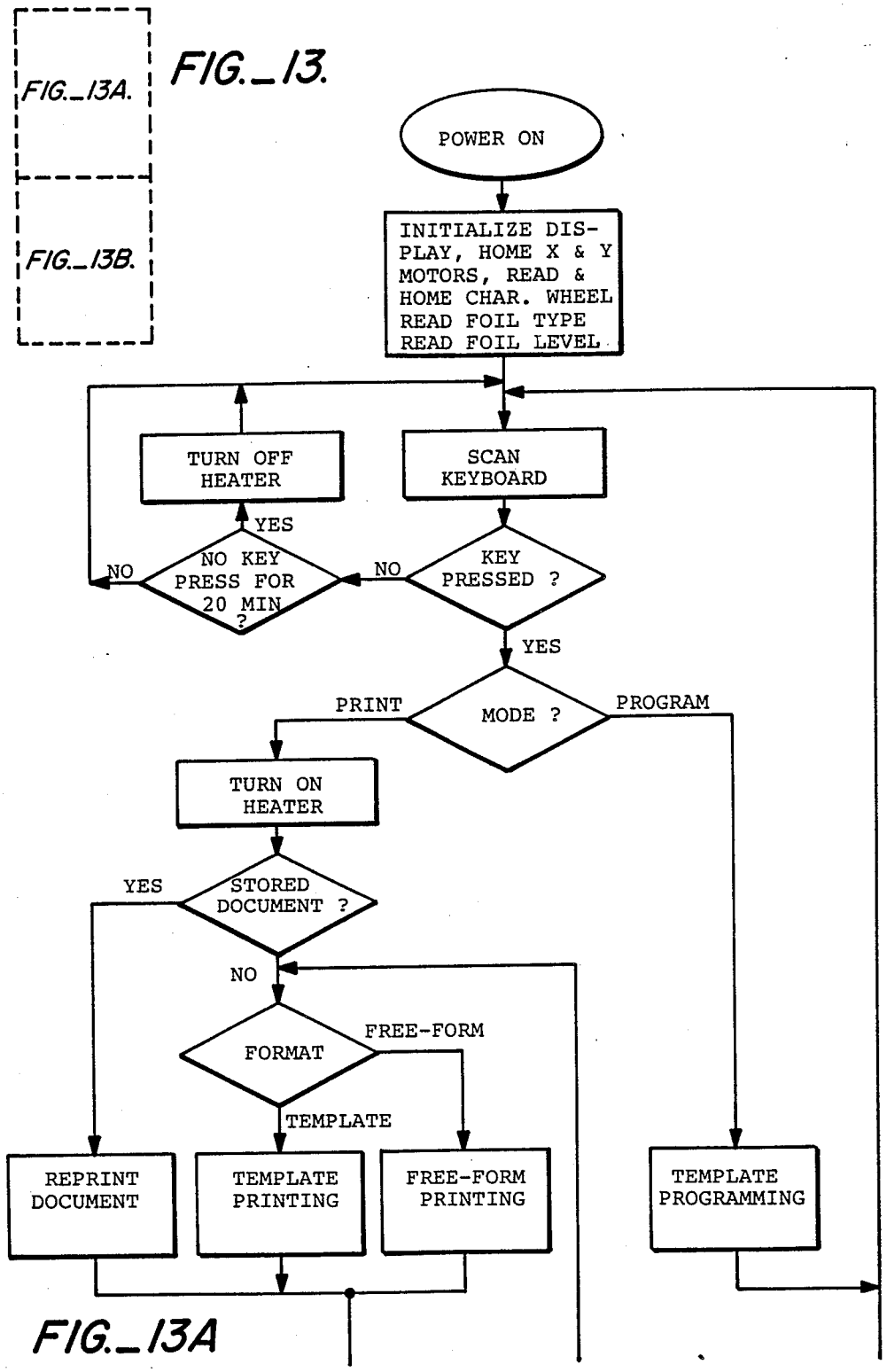
Figure 13B:
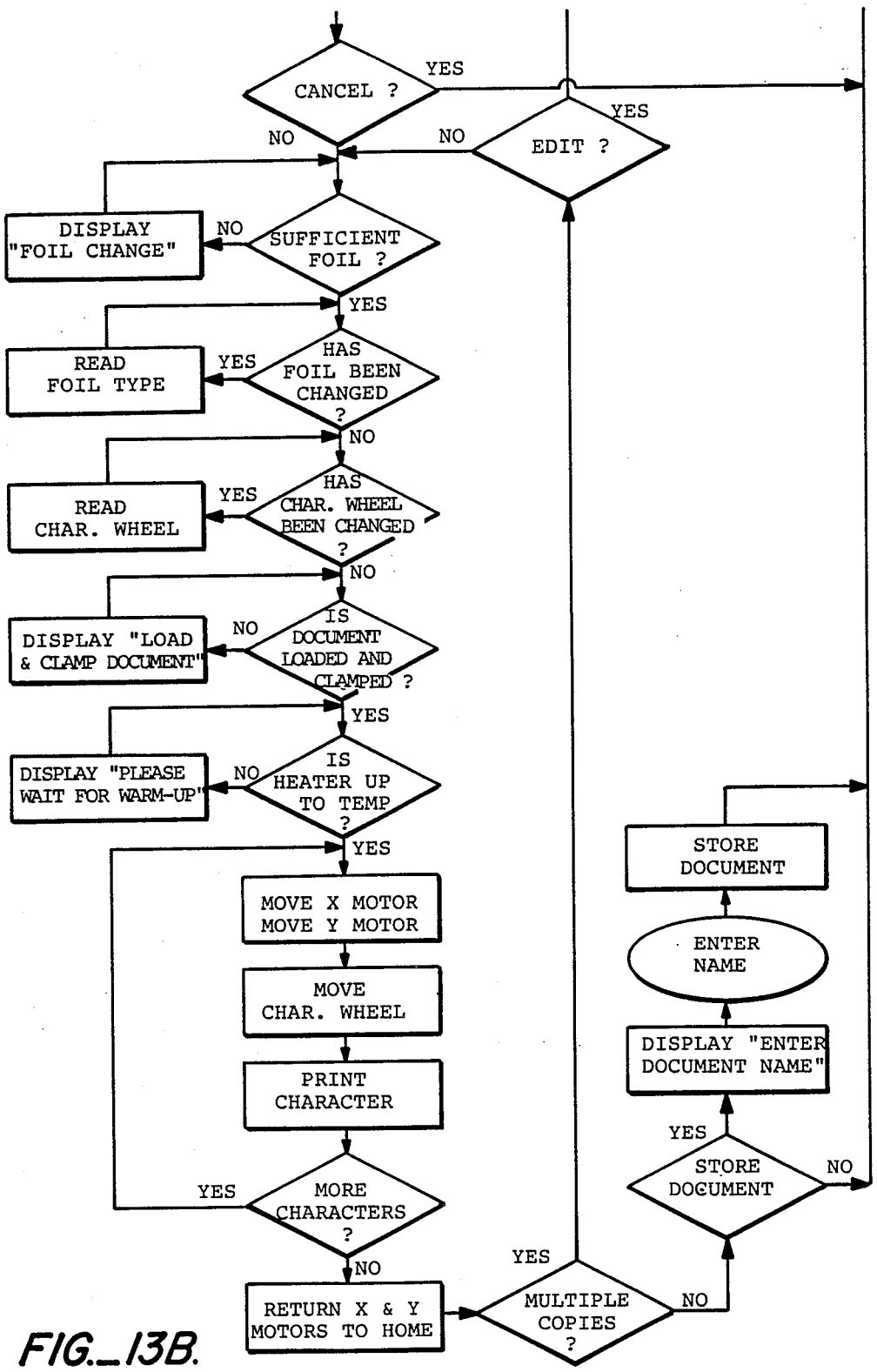

FIG. 13 is a flow diagram for a hot stamp printer of this invention. When power has been turned on, a display is initiated indicating the X and Y motors are in the home position. Detection is made of the particular character wheel installed and its home position. The foil type within the cartridge is detected as well as the remaining foil level. Various other tasks are performed, e.g. turning on or off the heater as required, determining what the print program mode shall be, whether or not a document is to be stored, the particular format, i.e., template printing where the user simply places text within a prescribed format, or freeform printing where the user "composes" the page by placing text wherever desired, and whether the document should be reprinted. During operation, detectors continue to indicate whether or not there is sufficient foil in the cartridge to complete the job, whether or not the foil cartridge has been changed, whether or not the character wheel has been changed, whether or not the workpiece is loaded and clamped by the clamping mechanism shown in FIGS. 6A and 6B, whether the heater is up to proper temperature, and this information, coupled with user input and machine memory and logic, provide for movement of the X and Y motors and the character wheel before initiating the print character instruction. After the character or programmed set of characters is printed, the X and Y motors are returned to home position. If multiple copies are not to be made, then the last question is whether or not the document instructions for that particular document are to be stored for reuse on subsequent workpieces of the same nature.

Figures 14, 14A, 14B:
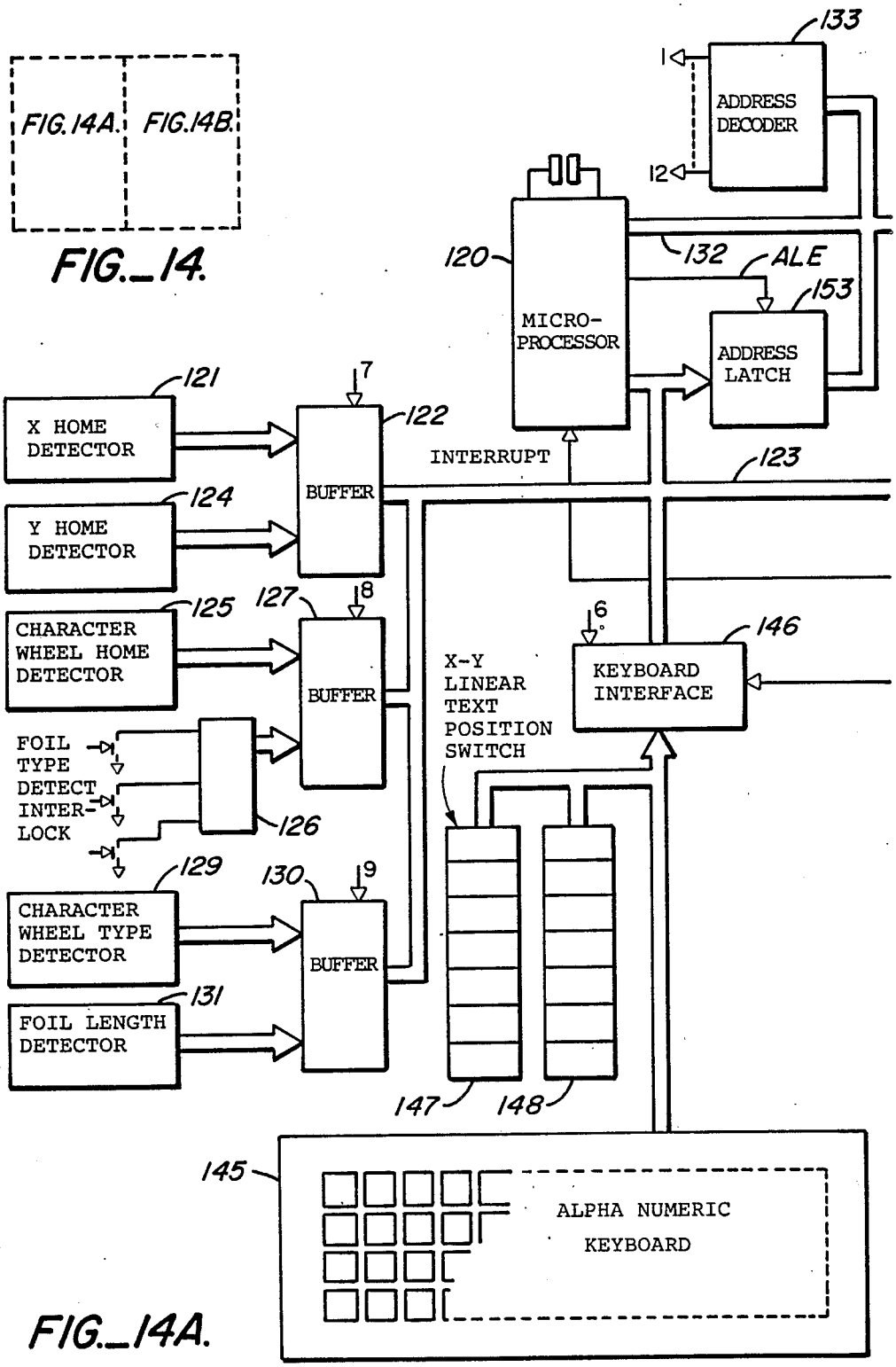
FIGS. 14, 14A and 14B are an electrical block diagram of the control system for the hot stamper printer of this invention.
Figure 14B:
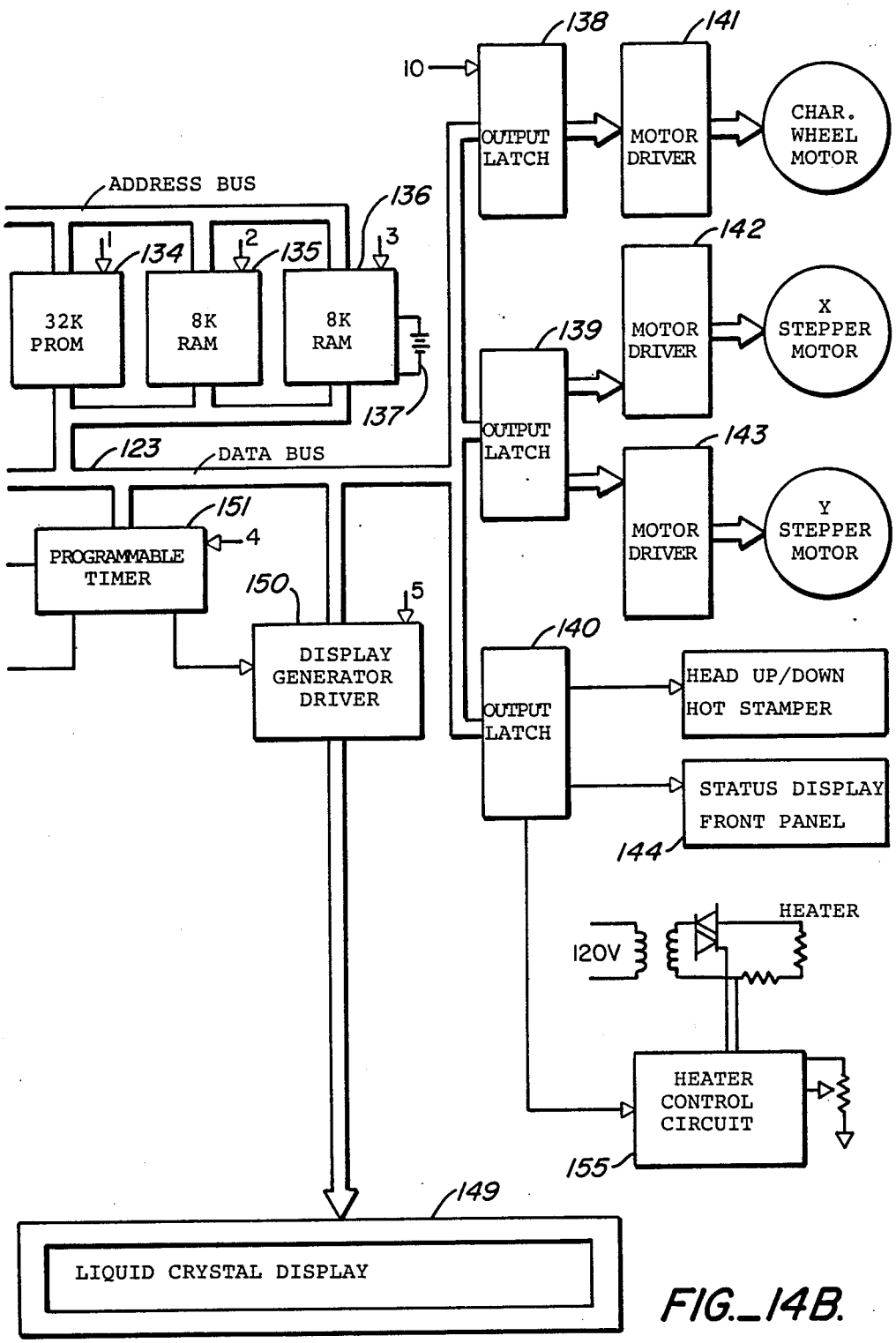

FIG. 14 is a block diagram of a circuit for controlling printing apparatus constructed in accordance with the present invention. The circuit of FIG. 14 includes a microprocessor 120 which receives a signal from an X-home detector circuit 121 when the print wheel is in the left most position. The one bit of data from X-home detector circuit 121 is presented to microprocessor 120 via a buffer 122 and a data bus 123. Similarly, microprocessor 120 receives a signal from a Y-home detector circuit 124 via buffer 122 and data bus 123 indicating when the print wheel is in the uppermost position. In a similar manner, microprocessor 120 receives data indicative of the character wheel position via a detector circuit 125 and the foil type via a circuit 126. Data from circuits 125 and 126 are passed to microprocessor 120 via a buffer 127 and data bus 123. The foil cartridge may have bumps used to encode the type of foil. These bumps may activate micro-switches or be detected using optical interrupter means. This information is used to change the operating characteristics of the heater and pressure mechanism and dwell time to improve printing quality. A character wheel type detector 129 provides a signal to microprocessor 120 via buffer 130 and data bus 123 indicative of the character wheel type being used in conjunction with the print apparatus. A foil length detector circuit 131 provides data to microprocessor 120 via buffer 130 and data bus 123 indicative of the amount of the foil left. This indicates to the microprocessor whether there is sufficient foil left for a print operation. When it is desired to read data from buffers 122, 127 or 130, microprocessor 120 provides an appropriate address on an address bus 132 which is decoded by an address decoder circuit 133. Address decoder circuit 133 selects one of buffers 122, 127 or 130 in response to the address placed on address bus 132. In addition, as described below, address decoder 133 is also used to select various circuits coupled to data bus 123, thereby controlling flow of information between these circuits and microprocessor 120.

Also coupled to address bus 132 is a program store PROM 134 and two scratch pad memories 135 and 136. Of importance, scratch pad memory 136 is coupled to a backup battery 137 so that the data stored in scratch pad memory 136 can be preserved in the event of an accidental power down. Memory devices 134, 135 and 136 communicate with microprocessor 120 via data bus 123.

Microprocessor 120 controls the print wheel apparatus by writing appropriate data into latches 138, 139 and 140 via data bus 123. Of importance, latches 138, 139 and 140 are selected by address decoder 133. The data stored in latch 138 controls a motor driver 141 which in turn controls the character wheel stepper motor. Similarly, the data stored in latch 139 controls a motor driver 142 which controls the X-stepper motor and a motor driver 143 which controls the Y-stepper motor. The data stored in latch 140 controls the print head up/down hot stamper, enables heater control circuit 155, and provides data to a status display 144. Thus, by writing appropriate data to latch 140, various status signals can be displayed to an operator via display 144 located on the front panel of the apparatus.

Microprocessor 120 receives information from a manually operable alpha-numeric keyboard 145 via a key board interface circuit 146. Keyboard interface circuit 146 is of a type which periodically queries the state of each key within alpha-numeric keyboard 145. When keyboard interface circuit 146 is queried by microprocessor 120, circuit 146 provides data on bus 123 indicative of the identity of any key within keyboard 145 that is being actuated. In addition, keyboard interface circuit 146 provides a word of data indicative of the state of X, Y linear text position switches 147 and 148 corresponding to schematically shown switches 23 (FIG. 1).

A liquid crystal display 149 receives data from microprocessor 120 via data bus 123 and a display generator driver circuit 150. In this way, microprocessor 120 provides additional indications of machine status to an operator of the print apparatus. A programmable timer circuit 151 provides timing signals to the liquid crystal display circuit 150 and keyboard interface circuit 146 in response to instructions from microprocessor 120. In additional, programmable timer 151 periodically provides interrupt signals on an interrupt signal line 152 indicating when it is time to query keyboard interface circuit 146 or provide data to display generator driver 150.

In one embodiment of the invention, microprocessor 120 is of a type which multiplexes both address information and data information on bus 123. Accordingly, in such an embodiment, a latch 153 is provided for storing address information when that address information is present on bus 123. A signal received on an address latch enable line ALE causes latch 153 to store address information.

In one embodiment, the components illustrated in FIG. 14 are as follows:

| Device | Model Number | Manufacturer |
|---|---|---|
| 120 | 8085AH | Intel |
| 122, 127, 130 | 74LS244 | TI |
| 138, 139, 140, 153 | 74LS373 | TI |
| 133 | 74LS138 | TI |
| 151 | 8254 | Intel |
| 134 | 27256 | Intel |
| 135, 136 | 5565 | Toshiba |
| 142, 143 | ULN 2003A | Sprague |
| 141 | L293E | SGS |

Figure 15:
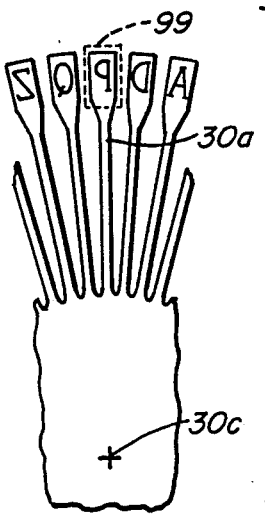
FIG. 15 is a partial top view of character wheel fingers used in one embodiment of the invention.
Figure 16:
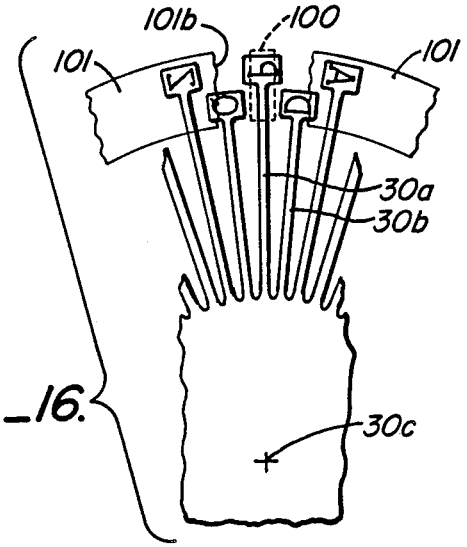
FIG. 16 is a partial top view of an alternative embodiment of the character wheel fingers.

FIG. 15 schematically illustrates a few of the normally 96 fingers on the character wheel and the foot-print 99 of a desired heating area of the fingertip of finger 30*a* and each succeeding finger as the fingers rotate into print position about axis 30*c*. A modified form of character wheel is seen in FIG. 16 in which multiple sets of inner finger ends and outer finger ends are provided on alternative fingers 30*a* and 30*b*. In this case, a larger heater foot-print 100 is required to cover both the inner and outer character-containng areas so as to allow serial printing with both sets of characters. This allows more characters on a single character wheel or characters in a new orientation (orthogonal to the previous orientation) on approximately the same size wheel. Alternatively, the entire print wheel or its peripheral characters may be preheated to or near operating temperature by means such as a fixed ring heater 101 segmented as at **101*b*** to allow the strike motion of the finger tip.

Figure 16A:
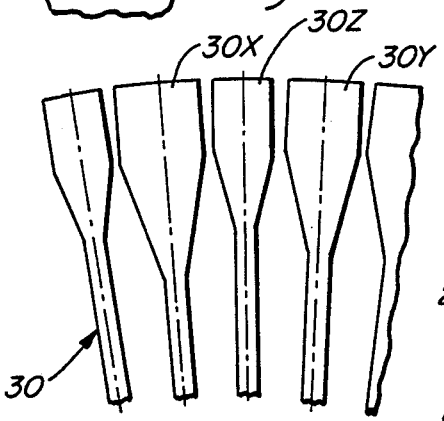
FIG. 16A is a partial top view of a preferred print wheel.

FIG. 16A shows a standard 96-finger print wheel modified at the end of the fingers to accommodate three or more widths of character pads **30*x*, 30*y* and 30*z*. This optimizes the utilization of the peripheral spacing on the wheel and increases the density and width of large characters, e.g. a "w", on a given diameter print wheel while minimizing the width of a character pad for a narrow character, e.g. an "i". Character pads of 0.172", 0.212" and 0.252" are typical pad widths for pad 30*z*, 30*y* and 30*x***, respectively.

Figure 17:
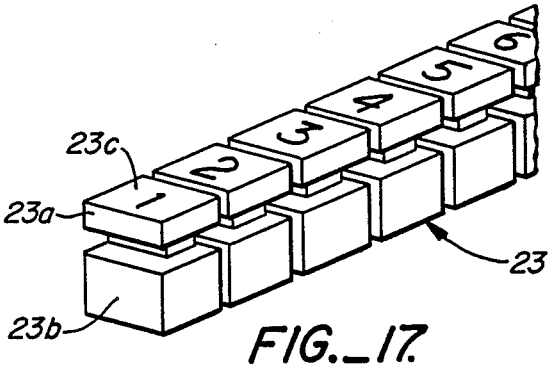
FIG. 17 is a perspective view of mechanical selection switches used to electrically orient a workpiece on a working surface of the printer.

FIG. 17 illustrates a preferred form of linear array of electro-mechanical switches 23 with depressible key **23*a* and switch body 23*b*. Switches 23 are utilized to indicate to microprocessor 120 the desired position with respect to the workpiece for the text being entered (e.g. as indicated by indicia 23*c***), i.e. during composing. One linear array is used to position in the X-direction; a second array is used in the Y-direction.

Figures 18, 18A:
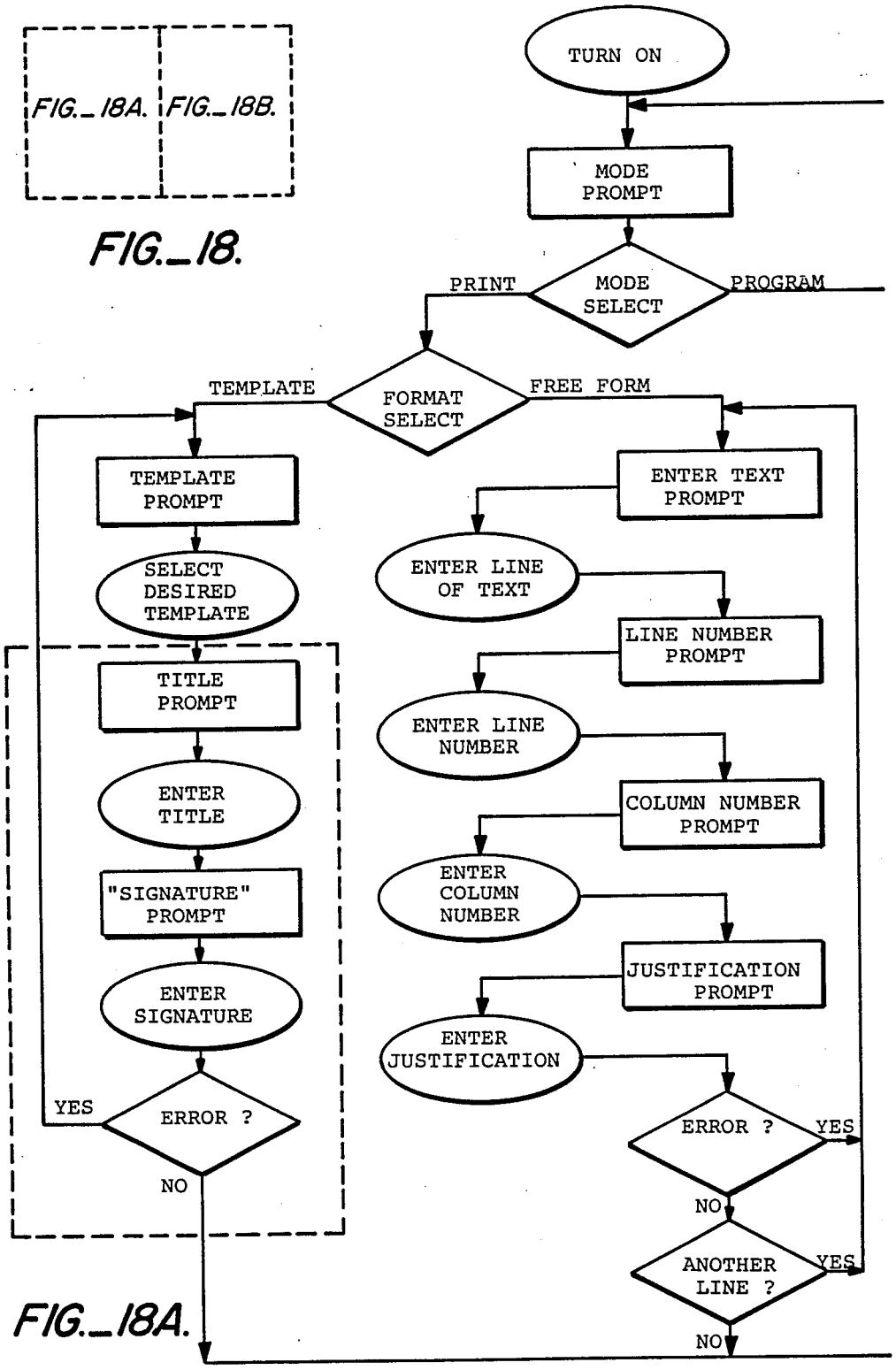
FIGS. 18, 18A and 18B are a user interface flowchart employed in operating the printer.
Figure 18B:
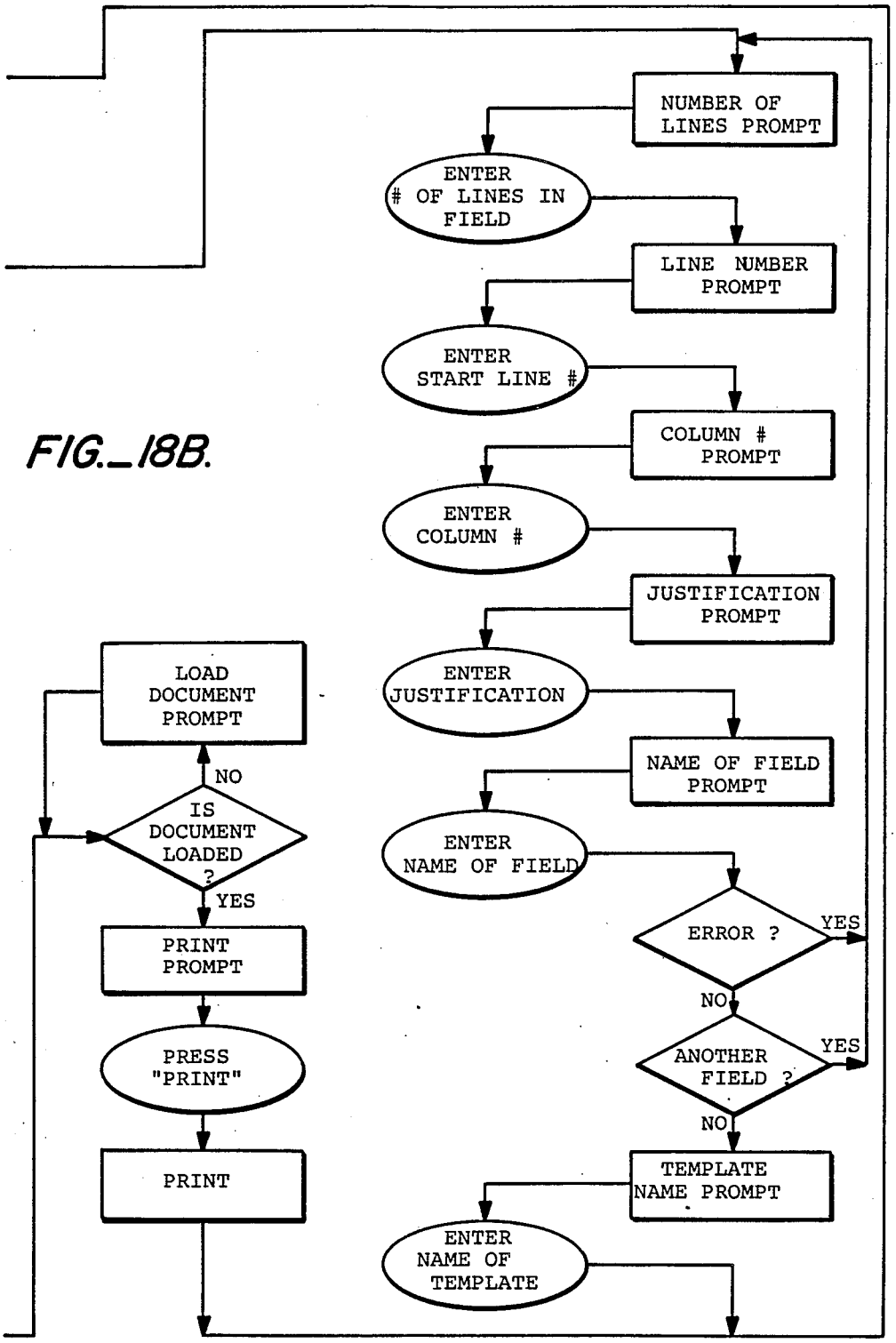

FIG. 18 represents a user interface flow chart that may be employed by the operator in operating the stamp printer of the invention. It allows for various inputs by the operator to program certain desired text on the workpiece in certain areas and provides for overall actuation of the printer by actuation of a "PRINT" or "START" button for printing of the desired character(s) on the workpiece.

Character wheel 30 is termed herein as an indicia means for printing indicia on that wheel by pressing the indicia means down on a foil tape above an adjacent workpiece. Other indicia means may be employed with this invention such as a dot matrix head using solenoid-operated movable pins to press each pin dot against the foil tape causing the imprint material to be transferred from the tape into a resultant indicia such as a logo or a character on the workpiece. Alternatively, a pressure operated stylus may be employed which is drawn over the type surface exposed in the tape cartridge and periodically moved downwardly to pressure transfer material from the tape to a workpiece positioned thereunder.

The printer may be further programmed and the print cycle, dwell time, and heat levels may be adjusted to compensate for various type and surface textures, e.g. smooth paper, vinyl, leather or other embossed or smooth cover stocks, of the workpiece to be printed.

The above description of embodiments of this invention is intended to be illustrative and not limiting. Other embodiments of this invention will be obvious to those skilled in the art in view of the above disclosure.

We claim:

1. In combination, a serial flat bed heated-finger Daisy wheel hot debossing stamper comprising:

a classis having a flat work surface for mounting a workpiece to be debossed;

a gantry connected to said chassis and extending above said working surface;

a debossment assembly movable with respect to said gantry for debossing said workpiece mounted on a portion of said work surface, said debossment assembly comprising:

means for moving said debossment assembly along said gantry parallel to an x-axis of said work surface;

a Daisy-wheel debossment head including a rotating character wheel generally extending in a plane parallel to said work surface and having a series of character fingers thereon individually movable out of a plane of storage, means including a motor and drive shaft for rotating said wheel, said wheel being quick-disconnected onto said shaft;

a foil tape having a heat and pressure transferable material thereon, said tape being in a cartridge mounted in said assembly such that said transferable material extends between a workpiece on said work surface and a character on a finger of said character wheel at a debossment zone;

means for individually heating said character on said wheel only in the immediate vicinity of said character; and pressure means operable for exerting pressure on said finger, said heated character and said transferable material to simultaneously transfer said material from said foil tape to said workpiece and to deboss said material representative of said character onto said workpiece on said work surface; and a keyboard and control unit for controlling debossment of a straight line of individual character debossments across said workpiece; for controlling relative movement of said workpiece and said assembly line-by-line; for controlling movement of said character wheel with respect to said pressure means; and for controlling movement of said pressure means to deboss said material from said tape.

2. The stamper of claim 1 wherein said gantry is fixed with respect to said casing and is oriented along an X-axis of said work surface and wherein said chassis further includes means for moving a workpiece to and from said assembly and said gantry on a Y-axis orthogonal to said X-axis.

3. The stamper set forth in claim 1 comprising means on said rotating character wheel for detecting the type font of characters on said wheel and wherein said control unit includes means for determining the time and temperature to imprint foil material on a workpiece dependent on a determined type font.

4. The stamper set forth in claim 1 further including a motor-driven pressure head for operably moving said pressure means.

5. The stamper set forth in claim 4 in which said pressure means further includes a cam-operated head for exerting pressure on said character wheel and said transfer foil.

6. The stamper set forth in claim 1 in which said pressure means includes a motor-driven head and said debossment assembly includes means for advancing transfer foil intermittently in said cartridge after each actuation of said motor-driven head.

7. In combination, a serial flat bed heated-finger Daisy wheel hot debossing stamper comprising:

a chassis having a flat work surface for mounting a workpiece to be debossed;

a gantry connected to said chassis and extending above said working surface;

a debossment assembly on said gantry for debossing said workpiece mounted on a portion of said work surface, said debossment assembly comprising:

means for moving said debossment assembly along said gantry parallel to an x-axis of said work surface;

a Daisy-wheel debossment head including a rotating character wheel generally extending in a plane parallel to said work surface and having a series of character fingers thereon individually movable out of a plane of storage, means including a drive shaft for rotating said wheel, said wheel being quick-disconnected onto said shaft;

a foil tape having a heat and pressure transferable material thereon, said tape being in a cartridge mounted such that said transferable material extends between a workpiece on said work surface and a character on said character wheel at a debossment zone;

means for individually heating said character on said wheel only in the immediate vicinity of said character; and pressure means operable for exerting pressure on said heated character and said transferable material to simultaneously transfer said material from said foil tape to said workpiece and to deboss said material representative of said character onto said workpiece on said work surface; and a keyboard and control unit for controlling debossment of a straight line of character debossments across said workpiece and for relative movement of said work surface and said workpiece line-by-line; movement of said character wheel with respect to said pressure means; and movement of said pressure means to deboss said material from said tape and transfer stamp serially multiple lines of characters into said workpiece;

further including a cam means for operably moving said pressure means and in which said means for heating includes a heating head actuatable by said cam means and extending between said cam means and said rotating character wheel.

8. The stamper set forth in claim 7 in which said heating head includes a heating rod therein for variably heating said heating head.

9. A book cover impression stamper comprising:

a flat work surface for a book cover;

a fixed gantry extending across parallel edges of said work surface;

an impression assembly connected to and movable across said gantry, said impression assembly comprising:

a Daisy-wheel impression head generally in a plane parallel to said work surface and containing a series of character-containing fingers movable into a stamping position;

a heat and pressure transfer foil in a cartridge mounted to said impression assembly and having said heat and pressure transferable foil movable therein;

means for moving said block cover orthogonally with respect to said gantry;

means for individually heating individual ones of said character-containing fingers immediately prior to stamping; and pressure means for moving any one of said series of fingers downwardly out of its plane of storage for stamping such that a heated character moves against said foil for transferring a transferable portion of said foil representative of said character to a book cover on said work surface.

10. The stamper of claim 9 further including a keyboard and control unit in electrical connection to said impression assembly to control movement of said impression head, said foil, and said pressure means.

11. The stamper of claim 10 in which said control unit serially stores information indicative of desired movement of said impression head, said foil, and said pressure means; and means for serially triggering said programmed movements and stamping operations on said book cover.

12. The stamper of claim 9 wherein said means for heating said fingers includes means for preheating characters only at their periphery wherein said means for preheating comprises a segmented ring in contact with individual ones of said characters at ends of said fingers.

* * * * *

UNITED STATES PATENT AND TRADEMARK OFFICE

CERTIFICATE OF CORRECTION

PATENT NO. : 4,930,911

DATED : June 5, 1990

INVENTOR(S) : Sampson, et al.

It is certified that error appears in the above-identified patent and that said Letters Patent is hereby corrected as shown below:

Col. 12, line 19, change "block" to --book--.

Signed and Sealed this

Twenty-eighth Day of September, 1993

*Attest:*

*Attesting Officer*

BRUCE LEHMAN

*Commissioner of Patents and Trademarks*